US008910934B2

(12) United States Patent
Yamazaki

(10) Patent No.: US 8,910,934 B2
(45) Date of Patent: Dec. 16, 2014

(54) SHEET EJECTING DEVICE

(71) Applicant: Masaru Yamazaki, Tokyo (JP)

(72) Inventor: Masaru Yamazaki, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/744,654

(22) Filed: Jan. 18, 2013

(65) Prior Publication Data

US 2013/0187328 A1 Jul. 25, 2013

(30) Foreign Application Priority Data

Jan. 25, 2012 (JP) ..... 2012-012558

(51) Int. Cl.

| | |
|---|---|
| ***B65H 43/00*** | (2006.01) |
| ***B65H 29/00*** | (2006.01) |
| ***B65H 29/14*** | (2006.01) |
| ***B65H 31/10*** | (2006.01) |
| ***B65H 31/36*** | (2006.01) |
| ***G03G 15/00*** | (2006.01) |

(52) U.S. Cl.

CPC ..... *B65H 29/00* (2013.01); *B65H 29/14* (2013.01); *B65H 31/10* (2013.01); *B65H 31/36* (2013.01); *G03G 15/6552* (2013.01); *B65H 2405/50* (2013.01); *B65H 2801/27* (2013.01)

USPC ..... 271/176; 271/189; 271/306

(58) Field of Classification Search

USPC ..... 271/306, 187, 224, 278, 84, 85, 176, 271/189

See application file for complete search history.

(56) References Cited

U.S. PATENT DOCUMENTS 4,969,641 A * 11/1990 Fukushima et al. ..... 271/187
7,434,804 B2 * 10/2008 Hanada et al. ..... 271/270

FOREIGN PATENT DOCUMENTS

| | | |
|---|---|---|
| JP | 2005-350269 | 12/2005 |
| JP | 2008-273656 | 11/2008 |
| JP | 2011-079620 | 4/2011 |
| JP | 2011-140367 | 7/2011 |

* cited by examiner

*Primary Examiner* — Michael McCullough
*Assistant Examiner* — Howard Sanders
(74) *Attorney, Agent, or Firm* — Lucas & Mercanti, LLP

(57) ABSTRACT

Disclosed is a sheet ejecting device. The sheet ejecting device includes a sheet stacking section; a bumping section; a sheet ejecting section; a mode selecting section; and a control section. The sheet ejecting section includes a pair of sheet clamping members which clamps one sheet or a plurality of overlapped sheets at a sheet clamping position and moves the one sheet or the plurality of overlapped sheets to a sheet stacking position in the sheet stacking section. The mode selecting section allows selection of an operation mode of the pair of sheet clamping members between a normal mode in which speed of the pair of sheet clamping members is a normal speed and a low speed mode in which a speed is lower than the normal speed.

12 Claims, 6 Drawing Sheets

SHEET EJECTING DEVICE

CROSS REFERENCE TO RELATED APPLICATION

This Application claims the priority of Japanese Application No. 2012-012558 filed Jan. 25, 2012, and which is incorporated by reference herein.

BACKGROUND

1. Field of the Invention

The present invention relates to a sheet ejecting device.

2. Description of Related Art

Typically, an image forming apparatus including a post-processing device such as a printer, copier, etc. is provided with a placement stage to temporarily stock a plurality of sheets on which images are formed in the apparatus and a sheet placement stage such as a sheet ejection tray to stock sheets ejected outside the apparatus.

Conventionally, when a sheet is ejected to such sheet placement stage, there is a problem that the stacking position is misaligned anywhere between from when the sheet separates from the sheet conveying roller directly before the sheet placement stage to when the sheet drops by its own weight onto the sheet placement stage and is stacked, and the sheets are not stacked on the sheet placement stage in a state where the edges of the sheets are aligned.

This problem occurs regardless of whether the placement face of the sheet placement stage is a horizontal configuration or is a tilted configuration. The problem especially occurs when the sheet conveying speed is high or when the environmental conditions are severe such as high temperature and high humidity or low temperature and low humidity.

In view of the above, there is disclosed a technique where sheets are stacked in a stacker, an edge of the stacked sheets is gripped with a gripper, and the gripper is moved to stack the sheets on the sheet ejection tray (for example, Japanese Patent Application Laid-Open Publication No. 2008-273656).

When a sheet which slips such as a coated sheet, thick sheet, etc., is gripped with the gripper, or when two overlapped normal sheets are gripped with the gripper, there is a possibility that the sheets slip even when gripped with the gripper and the sheets are not properly stacked on the sheet ejection tray. Specifically, this can be seen clearly in a high speed machine. In order to avoid the above problems, it is possible to consider increasing the gripping force of the gripper. However, this results in creases, folds, etc. easily forming on the sheets which is not a preferable state.

SUMMARY

The present invention has been made in consideration of the above problems, and it is one of main objects to enhance alignment of the sheets which easily slip when stacking the sheets without increasing the gripping force of the gripper.

In order to achieve at least one of the above-described objects, according to an aspect of the present invention, there is provided a sheet ejecting device including:

a sheet stacking section to stack a sheet ejected one sheet at a time or sheets ejected in a state where a plurality of sheets are overlapped by an ejecting section of an image forming device;

a bumping section which is bumped by a rear edge in a sheet ejecting direction of the sheet stacked on the sheet stacking section;

a sheet ejecting section including a pair of sheet clamping members which clamps the one sheet or the plurality of overlapped sheets at a sheet clamping position and moves the one sheet or the plurality of overlapped sheets to a sheet stacking position in the sheet stacking section;

a mode selecting section to select an operation mode of the pair of sheet clamping members between a normal mode in which an operation speed of the pair of sheet clamping members is a normal speed and a low speed mode in which a speed is lower than the normal speed; and a control section which operates the pair of sheet clamping members based on a selected result of the mode selecting section.

Preferably, the mode selecting section selects the normal mode or the low speed mode based on sheet type information of the ejected sheet.

Preferably, the mode selecting section selects the normal mode or the low speed mode based on a number of the overlapped sheets ejected.

Preferably, the mode selecting section selects the normal mode or the low speed mode based on a sheet conveying speed from the image forming device or an interval of a conveyed sheet from the image forming device.

Preferably, the sheet ejecting device further includes an operation section to input an optionally selected operation mode to the mode selecting section, wherein the mode selecting section selects the normal mode or the low speed mode based on an operation mode selected by the operation section.

BRIEF DESCRIPTION OF THE DRAWINGS

The present invention will become more fully understood from the detailed description given hereinbelow and the appended drawings, and thus are not intended to define the limits of the present invention, and wherein.

DETAILED DESCRIPTION OF PREFERRED EMBODIMENTS

Below, an embodiment of the present invention is described with reference to the drawings. However, the present invention is not limited to the illustrated examples.

First, the configuration is described.

Figure 1:
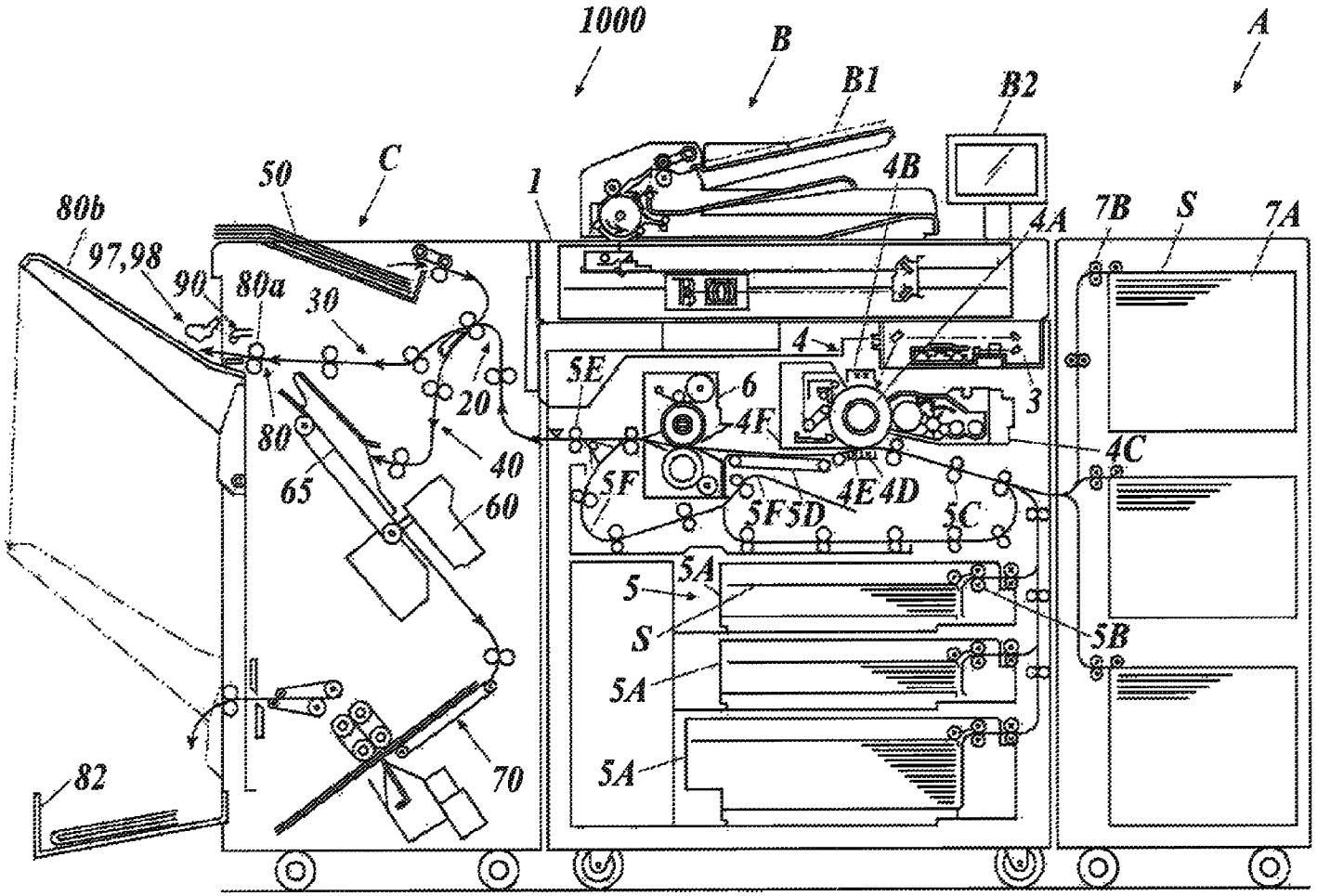
FIG. 1 is a diagram showing an entire configuration of an image forming system of a present embodiment.
Figure 2:
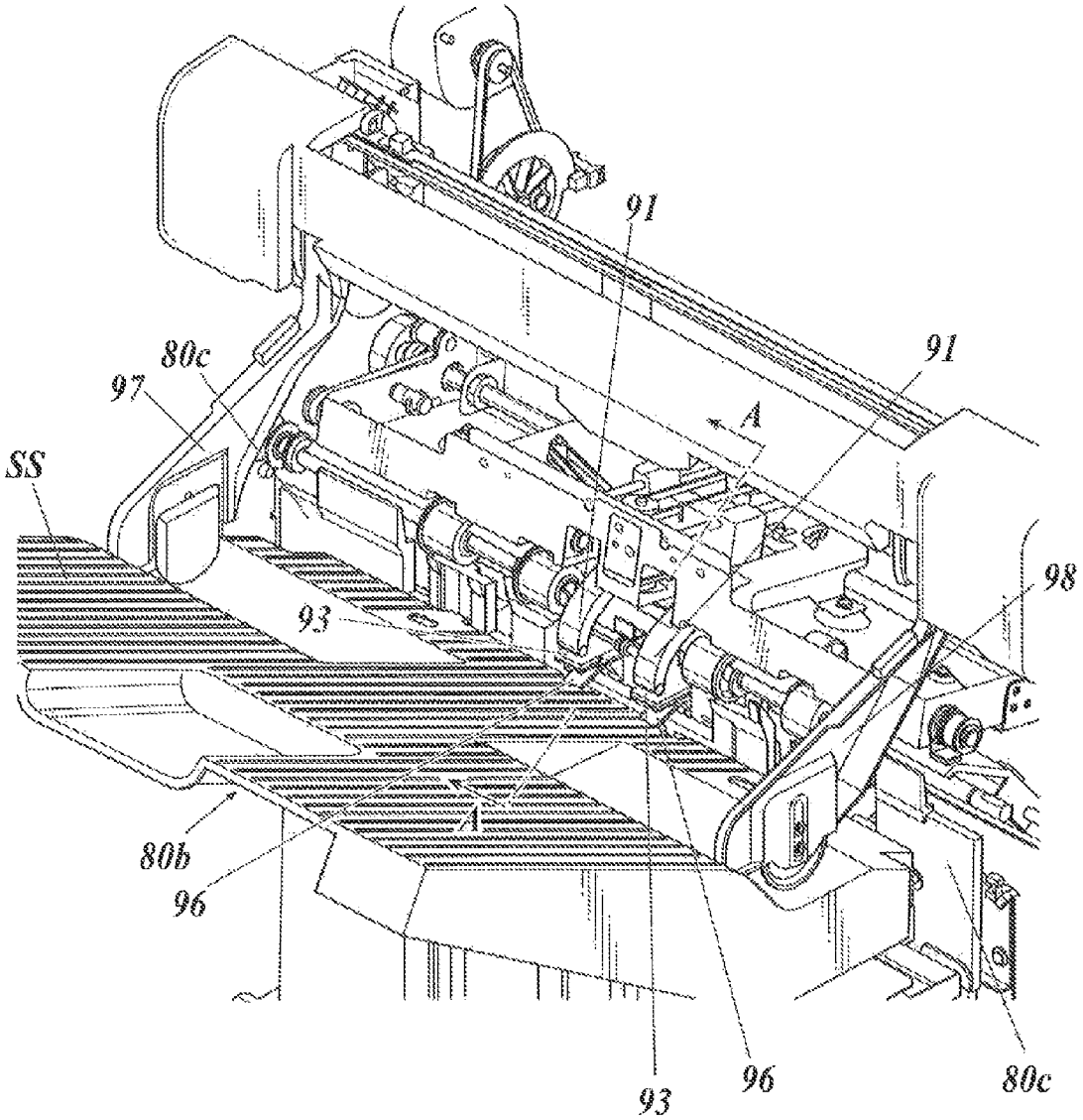
FIG. 2 is a perspective diagram showing a sheet ejecting mechanism section and a sheet ejecting section.
Figure 3:
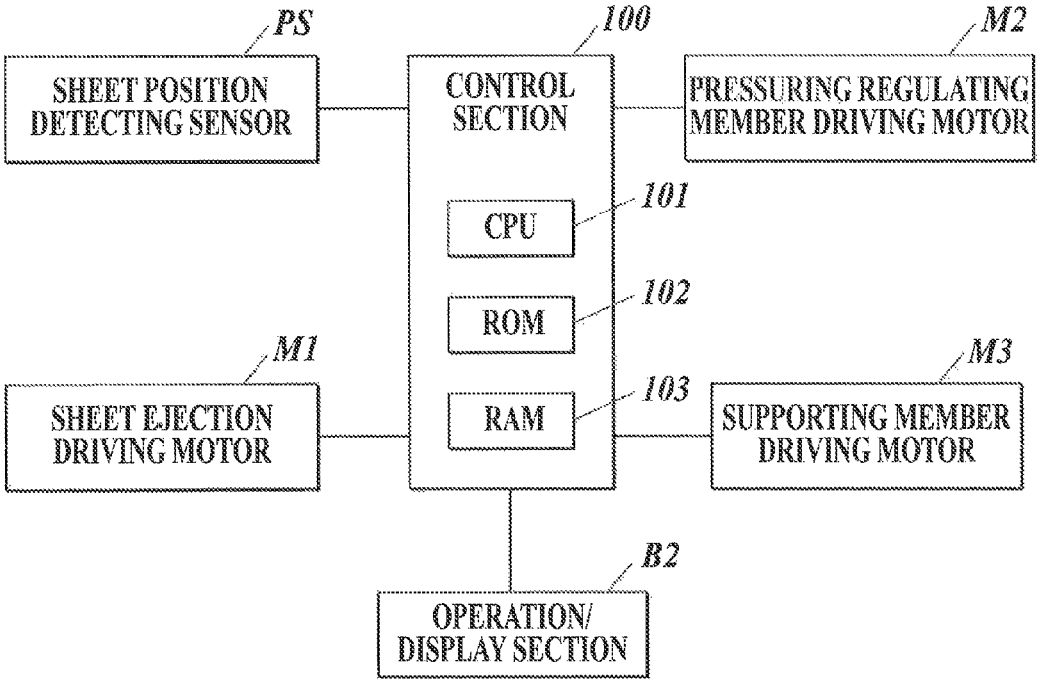
FIG. 3 is a block diagram showing a control configuration of the image forming system.

As shown in FIG. 1 to FIG. 3, an image forming system 1000 of the present embodiment includes a high capacity sheet feeding device A, an image forming device B, a post-processing device C, and a control section 100 which centrally controls the entire image forming system 1000.

(High Capacity Sheet Feeding Device A)

The high capacity sheet feeding device A includes a sheet storing section 7A, a first sheet feeding section 7B and the like.

The sheet storing section 7A stores large amounts of sheets S such as A4 size, A3 size, etc. The sheet S stored in the sheet storing section 7A is successively sent to the image forming device B by the first sheet feeding section 7B.

(Image Forming Device B)

The image forming device B includes an image reading section 1, an image writing section 3, an image forming section 4, a sheet feeding conveying section 5, a fixing section 6, an automatic document conveying section B1, an operation/display section B2 and the like.

The image reading section 1 includes a scanner at a bottom portion of a contact glass where a document is placed and reads an image on a sheet to obtain image data, The scanner includes an optical source, a COD (Charge Coupled Device) image sensor, an A/D converter, etc. The scanner images the reflected light of the light illuminated from the optical source and scanned on the document and performs photoelectric conversion to read the image of the document as an RGB signal. The signal converted by photoelectric conversion is transmitted to the image writing section 3 after performing processing such as A/D conversion, shading correction, image compression processing, and the like.

In the image writing section 3, the output light from the semiconductor laser is emitted on a photoreceptor drum 4A of the image forming section 4 and an electrostatic latent image is formed on the photoreceptor drum 4A.

The image forming section 4 includes a photoreceptor drum 4A, a charging section 4B, a developing section 4C, a transferring section 4D, a separating section 4E, a cleaning section 4F, and the like.

In the image forming section 4, processing such as charging, exposure to light, developing, transferring, separating, cleaning, etc. are performed on the electrostatic latent image formed on the photoreceptor drum 4A.

The sheet feeding conveying section 5 includes a plurality of sheet feeding cassettes 5A, a first sheet feeding section 5B, a second sheet feeding section 5C, a conveying section 5D, an ejecting section 5E, an automatic double face copying sheet feeding device (ADU) 5F and the like.

In the sheet feeding cassette 5A, sheet S discriminated in advance with respect to type of sheet (sheet type, basis weight, size) is stored and the sheet S is conveyed one sheet at a time from the top by the first sheet feeding section 5B to the second sheet feeding section 5C.

The second sheet feeding section 5C conveys the sheet S conveyed from the sheet feeding tray to the transferring section 4D of the image forming section 4. The sheet S on which the image is transferred with the transferring section 4D is conveyed to the fixing section 6 by the conveying section 5D.

The fixing section 6 is provided with a heating roller including a heating source and a pressuring roller which comes into contact with the heating roller to form a nipping section. The fixing roller fixes the toner image transferred on the sheet S by heating. The sheet S with the toner image fixed by the fixing section 6 is conveyed from the sheet ejecting section 5E to the post processing device C.

When images are formed on both faces of the sheet S, after fixing processing on the sheet S, the face of the sheet S is reversed in the automatic double face copying sheet feeding device 5F, the sheet S is sent to the image forming section 4 again to form an image and then the sheet S is sent to the post processing device C.

The automatic document conveying section B1 sends each sheet of a document placed on the document stage one sheet at a time to be supplied to the image reading section 1. The image on one face or both faces of the document supplied to the image reading section 1 from the document stage of the automatic document conveying section B1 is read by the optical system of the image reading section 1. The signal converted by photoelectric conversion is sent to the image writing section 3 after processing such as A/D conversion, shading correction, image compression processing, etc.

The operation/display section B2 is provided with a touch panel display including a LCD (Liquid Crystal Display) and displays on the display screen various setting screens, status of each device, operation status of each function, etc. according to an instruction of a display signal input from the control section 100.

The touch panel display is configured by covering the display screen of the LCD with a touch panel of a pressure-sensitive type (resistance film type) with transparent electrodes provided in a grid like shape. The touch panel detects the position coordinate pressed with the finger, touch pen, etc. by the voltage value.

The operation/display section B2 outputs a detected position signal as the operation signal to the control section 100.

The image forming device B shown in FIG. 1 forms a black and white image on the sheet S. Alternatively, the image forming device B can form a color mage on the sheet S.

(Post Processing Device C)

The post processing device C is a device which performs post processing such as binding processing. The post processing device C is provided with an entrance conveying section 20, an ejected sheet conveying section 30, a connection conveying section 40, an inserted sheet feeding section 50, a binding processing section 60, a stacking section 65, a folding section 70, a sheet ejecting mechanism section 80 and a sheet ejecting section 90 and the like.

In the entrance conveying section 20, the sheet S to be ejected from the post processing device C is sequentially received and conveyed.

The ejected sheet conveying section 30 conveys the sheet S where the post processing such as binding processing is not necessary. The sheet S conveyed through the ejected sheet conveying section 30 passes the sheet ejecting roller 80*a* to be ejected to the rising and falling sheet ejection dish 80*b*.

The connection conveying section 40 conveys the sheet S from the entrance conveying section 20 to the stacking section 65. The sheet S conveyed by the connection conveying section 40 is stacked in the stacking section 65 and binding processing is performed by the binding processing section 60. As a result, a book is made including a plurality of sheets S.

The inserted sheet feeding section 50 feeds the inserted sheet to the predetermined position in the binding processing. The sheet fed from the inserted sheet feeding section 50 passes through the connection conveying section 40 and is stacked in the stacking section 65.

The binding processing section 60 performs binding processing of a book including a plurality of sheets S stacked in the stacking section 65.

In one sided binding where puncture of the batch of sheets in the binding processing is performed on one side, the book is ejected to the rising and falling sheet ejection dish 80*b*. In center binding where puncture of the batch of sheets in the binding processing is performed in the center section, the book is folded inward in the folding section 70 and ejected to the sheet ejection dish 82.

The folding section 70 folds the book inward when performing center binding in the binding processing.

The sheet ejecting mechanism section 80 includes the sheet ejecting roller 80*a* as an ejecting section to eject the sheet S, the rising and falling sheet ejection dish 80*b* to stack the ejected sheet S, a bumping section 80*c* where a rear edge of the sheet S bumps, and the like.

The sheet ejecting roller 80*a* is connected to a sheet ejection driving motor M1 with variable speed and ejects the sheet S.

A sheet position detecting sensor PS is provided on the upstream side of the sheet ejecting direction of the sheet ejecting roller 80*a*. After detecting the approach of the sheet S with the sheet position detecting sensor PS, the rotating speed of the sheet ejecting roller 80*a* is reduced to match the timing.

By reducing the rotating speed of the sheet ejecting roller 80*a*, the sheet ejecting operation of the sheet ejecting section 90 can be secure.

The rising and falling sheet ejection dish 80*b* is formed with a stacking face SS as the sheet stacking section where the sheet S is stacked and the ejected sheet S is stacked with the sheet ejecting roller 80*a*.

The bumping section 80*c* is composed of two plate shaped members provided with a predetermined gap in between in a position on the upstream side of the sheet ejecting direction of the sheet S ejected by the sheet ejecting roller 80*a*.

The bumping section 80*c* is a reference to align the rear edge of the sheet S when the sheet S is stacked in the rising and falling sheet ejection dish 80*b*.

The sheet ejecting section 90 is provided in a position near the sheet ejecting mechanism section 80 and is a mechanism to stack the sheet S ejected by the sheet ejecting roller 80*a* aligned on the rising and falling sheet ejection dish 80*b*.

The sheet ejecting section 90 clamps the sheet S one sheet at a time or in a state where a plurality of sheets are overlapped at the sheet clamping position and includes a pressuring member 91 and a supporting member 93 as a pair of sheet clamping members to move the sheet S to the sheet stacking position in the sheet stacking section.

Here, the "sheet clamping position" is the position of the sheet S and the pressuring member 91 and the supporting member 93 when the sheet S is clamped by the pressuring member 91 and the supporting member 93.

Also, the "sheet stacking position" is the position of the sheet S and the pressuring member 91 and the supporting member 93 when the bottom face of the sheet S is in contact with the stacking face SS formed by the rising and falling sheet ejection dish 80*b* and the rear edge of the sheet S is in contact with the bumping section 80*c*.

In the present embodiment, as shown in FIG. 2, two pairs of the sheet clamping members (pressuring member 91 and supporting member 93) are provided in the gap between the two bumping sections 80*c*.

Figure 4A:
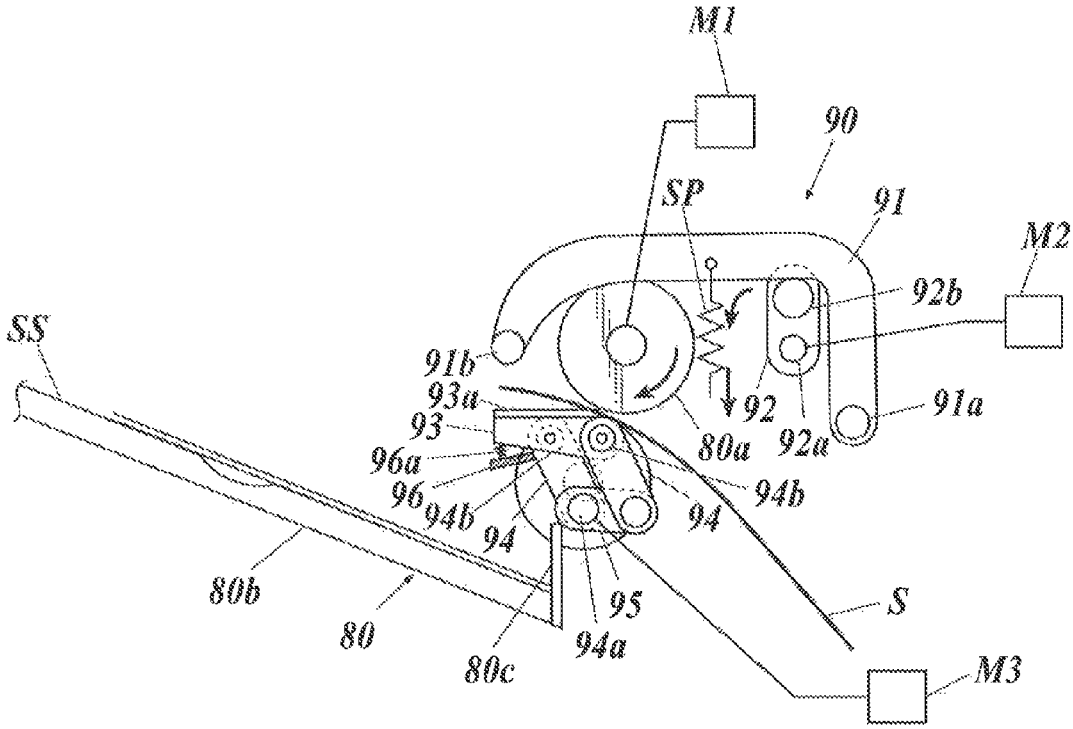
FIG. 4A is a cross-sectional diagram along line A-A shown in FIG. 2 for describing an operation of a pressuring member and a supporting member.
Figure 4B:
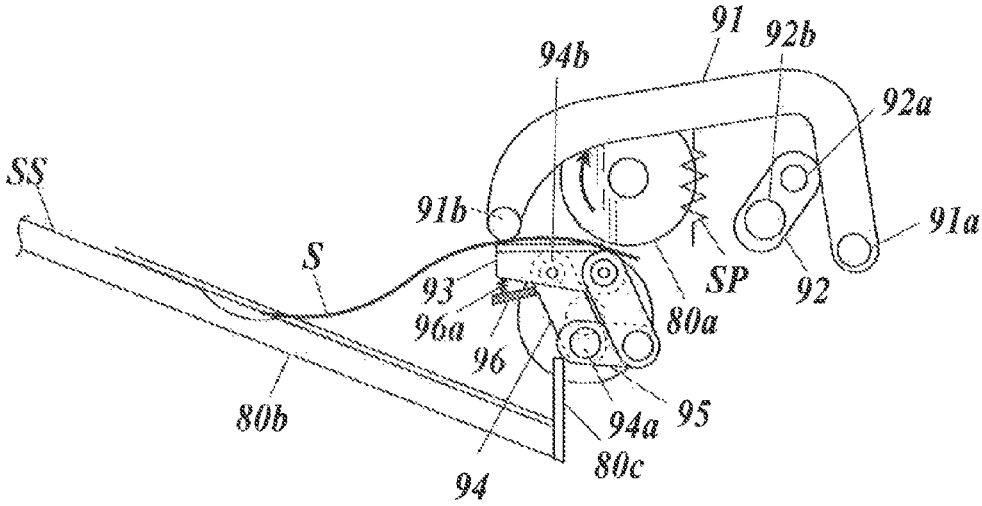
FIG. 4B is a cross-sectional diagram along line A-A shown in FIG. 2 for describing the operation of the pressuring member and the supporting member.

As shown in FIG. 4A, etc., the pressuring member 91 is held swingable around a rotating axis 91*a* parallel to the width direction of the sheet S on the upper side of the sheet S ejected from the sheet ejecting roller 80*a*.

Specifically, the pressuring member 91 is formed in an arm shape. One end of the pressuring member 91 is fixed with a rotating axis 91*a* which holds the pressuring member 91 swingably. The other end of the pressuring member 91 includes a pressuring section 91*b* which presses the supporting member 93 through the sheet.

A spring member SP to apply pressure to the pressuring section 91*b* for pressuring the supporting member 93 is latched to the pressuring member 91 and the spring member SP biases the pressuring member 91 in a direction to rotate in a counter clockwise direction.

The pressuring member 91 is separated from the supporting member 93 until the sheet S comes near the sheet clamping position and stands by in the upper evacuating position.

A pressuring regulating member 92 to regulate the position of the pressuring member 91 is provided in the position next to the pressuring member 91. A pressuring regulating member driving motor M2 which can rotate forward and reverse to drive the pressuring regulating member 92 is connected to the pressuring regulating member 92.

The pressuring regulating member 92 includes an axis section 92*a* which is connected to the pressuring regulating member driving motor M2 to hold the pressuring regulating member 92 rotatable in both forward and reverse directions and an engaging section 92*b* which engages with the pressuring member 91. The pressuring member 91 swings while latched to the engaging section 92*b* of the pressuring regulating member 92 which rotates in both forward and reverse directions.

Specifically, the rotation of the pressuring member 91 in the counter clockwise direction is regulated by the latching of the engaging section 92*b* attached to one edge of the rotating pressuring regulating member 92.

When the pressuring regulating member driving motor M2 rotates the pressuring regulating member 92 in the counter clockwise direction according to control of the control section 100, the regulating of the rotation of the pressuring member 91 in the counter clockwise direction is canceled.

When the pressuring regulating member driving motor M2 rotates the pressuring regulating member 92 in the clockwise direction according to control of the control section 100, the rotation of the pressuring member 91 in the counter clockwise direction is regulated.

The control section 100 operates the pressuring regulating member driving motor M2 according to the timing of the conveying of the sheet S detected by the sheet position detecting sensor PS.

Specifically, when the sheet S is conveyed by the sheet ejecting roller 80*a* and reaches the sheet clamping position, the pressuring regulating member 92 is rotated in the counter clockwise direction and the regulating of the pressuring member 91 is canceled according to detection by the sheet position detecting sensor PS.

According to the present embodiment, the pressuring member 91 swings latched to the engaging section 92*b* of the pressuring regulating member 92 which rotates in both forward and reverse directions. However, if it is possible to rotate the pressuring member 91 in both forward and reverse directions at predetermined timing, a configuration other than the above pressuring regulating member 92 is possible.

The supporting member 93 is maintained rotatable to rotate around the rotating axis 94*a* parallel in the width direction of the sheet S on the lower side of the sheet S ejected from the sheet electing roller 80*a*.

Specifically, the supporting member 93 is fixed to one edge of a pair of rotating plates 94 through a pair of axes 94*b*. The pair of rotating plates 94 are formed with the same dimensions and shape.

A pair of rotating axes 94*a* are fixed to the other edge of the pair of rotating plates 94 and the pair of rotating axes 94*a* are held rotatable by a holding plate 95.

A supporting member driving motor M3 which is a supporting member driving section to rotate each rotating axis 94*a* in the counter clockwise direction is connected to the pair of rotating axes 94*a*. The supporting member driving motor M3 is configured to rotate at the same speed in the same direction at the same time by control of the control section 100.

The phase of the pair of rotating plates 94 is misaligned in the rotating axis direction so that the pair of rotating plates 94 are provided not to influence each other when rotating.

The supporting member 93 is rotatable and movable by the pair of rotating plates 94, the pair of rotating axes 94*a*, the holding plate 95, the supporting member driving motor M3, etc. In other words, the pair of rotating plates 94 rotate at the same speed in the same direction at the same time to rotate the supporting member 93.

The supporting member driving motor M3 rotates the pair of rotating plates 94 once for each clamping operation of the sheet S by the pressuring member 91 and the supporting member 93 under the control of the control section 100.

A sheet clamping face 93*a* is formed on the supporting member 93 and the pressuring section 91*b* of the pressuring member 91 comes into contact with the sheet clamping face 93*a* through the sheet S. It is preferable that the sheet clamping member 93*a* is a face which constantly maintains a horizontal state or maintains a certain angle from the horizontal state regardless of the rotating angle of the pair of rotating plates 94.

As described above, since the sheet clamping face 93*a* is a face constantly maintaining a horizontal state or is a face constantly maintaining a certain angle from the horizontal state, the clamping operation of the sheet S by the pressuring member 91 and the supporting member 93 can be performed in a stable and smooth state.

Damaging processing is performed on the sheet clamping face 93*a* to enlarge the friction coefficient. The friction coefficient of the surface of the sheet clamping face 93*a* is set to be larger than the friction coefficient of the pressuring section 91*b* of the pressuring member 91 and larger than the friction coefficient between the sheets S.

As described above, by setting the friction coefficient of the sheet clamping face 93*a* of the supporting member 93 to be larger than the friction coefficient of the pressuring section 91*b* of the pressuring member 91, and to be larger than the friction coefficient between the sheets S, even when the sheet S stacked on the top face of the rising and falling sheet ejection dish 80*b* is misplaced on the downstream side of the sheet conveying direction, it is possible to easily correct the position.

The method of enlarging the friction coefficient is not limited to damaging processing. For example, it is possible to form the supporting member 93 with a molded resin component and a large number of small projections can be formed on the sheet clamping face 93*a*. It is also possible to attach a different member made from rubber, foaming flexible resin, etc. on the sheet clamping face 93*a*.

A friction member 96 is provided on the lower face (a face on the opposite side of the sheet clamping face 93*a*) of the supporting member 93 through a spring member 96*a*.

The friction member 96 is a friction plate formed from a material including rubber, foaming resin, etc. The friction coefficient on the sheet contact face (lower face) of the friction member 96 is set to a value larger than the friction coefficient between the sheets of the plurality of sheets S stacked on the rising and falling sheet ejection dish 80*b*.

The sheet contact face of the friction member 96 can be moved by the spring member 96*a*. Since the face of the friction member 96 which comes into contact with the sheet S can be moved, it is possible to maintain the friction resistance to the sheet S to substantially a certain state even when the thickness of the batch of sheets stacked on the rising and falling sheet ejection dish 80*b* changes.

As shown in FIG. 2, the sheet ejecting section 90 includes a pair of aligning members 97, 98 as sheet aligning sections to align the edge position of the sheet S in a direction in a right angle to the sheet ejecting direction of the sheet S ejected to the rising and falling sheet ejection dish 80*b*. The pair of aligning members 97, 98 are provided on the downstream side of the sheet ejecting direction and above the rising and falling sheet ejection dish 80*b*.

The pair of aligning members 97, 98 are provided facing each other with a predetermined gap in between in the sheet width direction. The pair of aligning members 97, 98 are rotatable centering around the rotating axis AX in a direction which approaches and separates with respect to the rising and falling sheet ejection dish 80*b*.

(Control Section 100)

As shown in FIG. 3, the control section 100 includes a CPU (Central Processing Unit) 101, a ROM (Read Only Memory) 102, a RAM (Random Access Memory) 103, and the like.

Control programs to control each section and various processing programs are recorded in the ROM 102 of the control section 100. A work area for the CPU 101 is included in the RAM 103.

The CPU 101 centrally controls operation of each section of the image forming system 1000 in coordination with the control program and the various processing programs.

An operation/display section B2 to input various operation instructions, various pieces of information, etc. is electrically connected to the control section 100. The control section 100 performs processing according to the operation instruction and various pieces of information input in the operation/display section B2.

Here, as information input in the operation/display section B2, there is sheet type information which shows the type of sheet on which the image is formed. Sheet type information includes not only information showing type of sheet such as coated sheet (sheet where the surface is coated), normal sheet, etc. but also information showing basis weight of the sheet, and the like.

Based on the sheet type information input in the operation/display section B2, the control section 100 selects an operation mode of the pair of sheet clamping members from between a normal mode in which the operation speed of the pair of sheet clamping members (pressuring member 91 and supporting member 93) is a normal speed and a low speed mode in which the speed is lower than the normal speed. Here, the operation speed of the pair of sheet clamping members is a speed from when the sheet S is clamped to when the rear edge of the sheet S in the clamped state comes into contact with the bumping section 80*c*. The operation speed of the pair of sheet clamping members in the operation of this interval depends on the rotating speed of the supporting member driving motor M3. In other words, the control section 100 controls the supporting member driving motor M3 to drive at the speed according to the selected operation mode.

Specifically, when the basis weight of the ejected sheet is a predetermined value or lower, the control section 100 selects the normal mode and when the basis weight of the ejected sheet is more than the predetermined value, the control section 100 selects the low speed mode.

Alternatively, when the ejected sheet is the normal sheet, the control section 100 selects the normal mode, and when the ejected sheet is a sheet with a surface which easily slips than a normal sheet (for example, coated sheet), the control section 100 selects the low speed mode. When the low speed mode is selected, since the operation of the pair of sheet clamping members is in a speed lower than the normal mode, the control section 100 lowers the conveying speed of the image forming device B side to correspond with the operation speed of the pair of sheet clamping members.

As described above, according to the present embodiment, the control section 100 functions as the mode selecting section which selects the operation mode of the pair of sheet clamping members (pressuring member 91 and supporting member 93) from between the normal mode and the low speed mode.

According to the present embodiment, the sheet ejecting device of the present invention is composed of the above described sheet ejecting mechanism section 80, sheet electing section 90 and control section 100.

Next, the operation of the sheet ejecting section 90 of the present embodiment is described with reference to FIG. 4A to FIG. 6B.

In the example described here, the sheet S is ejected by the sheet ejecting roller 80*a* and the pressuring member 91 and the supporting member 93 are driven.

Before the ejected sheet S reaches the sheet clamping position, when the front edge of the sheet S is clamped by the sheet ejecting rollers 80*a*, the pressuring member 91 stands by in the evacuating position separated from the supporting member 93. The supporting member 93 waits in the sheet clamping position where the sheet S is clamped (see FIG. 4A).

When on stand by, based on the sheet type information input on the operation/display section B2, the control section 100 selects the operation mode of the pair of sheet clamping members between the normal mode and the low speed mode.

Next, when the sheet S is conveyed by the sheet ejecting roller 80*a* and reaches the sheet clamping position, the pressuring regulating member 92 rotates in the counter clockwise direction according to the detection by the sheet position detecting sensor PS. With this, the regulation of the pressuring member 91 is canceled, and the pressuring member 91 rotates in the counter clockwise direction by the bias of the spring member SP to come into contact with the supporting member 93 so as to clamp the rear edge section of the sheet S to apply pressure (see FIG. 4B).

After a predetermined amount of time passes from the detection of the sheet S by the sheet position detecting sensor PS, the control section 100 controls the supporting member driving motor M3 to drive at the speed of the selected operation mode. When the supporting member driving motor M3 rotates, the pair of rotating plates 94 rotates to start movement of the supporting member 93. The supporting member 93 rotates in the counter clockwise direction at the operation speed corresponding to the selected operation mode by the rotation of the pair of rotating plates 94.

Figure 5A:
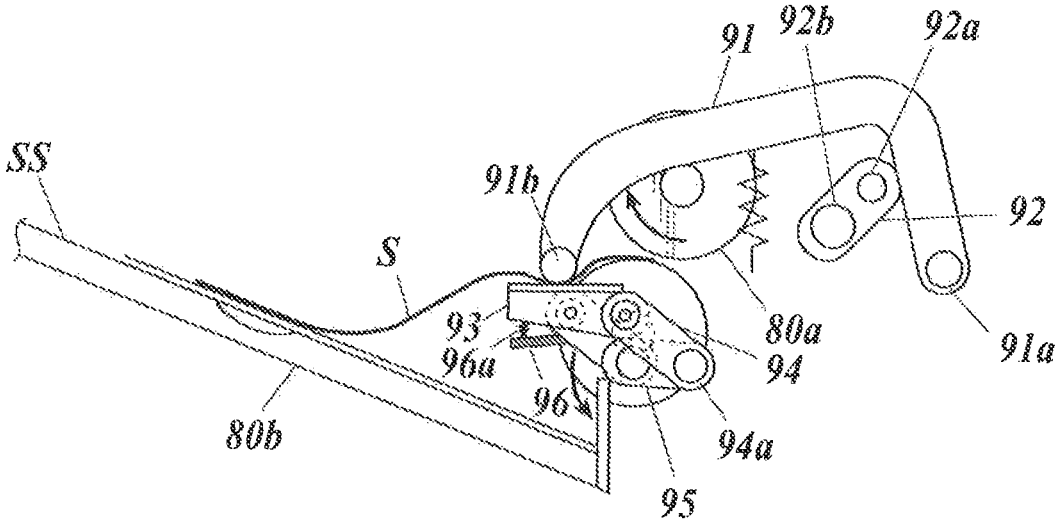
FIG. 5A is a cross-sectional diagram along line A-A shown in FIG. 2 for describing the operation of the pressuring member and the supporting member.

When the supporting member 93 rotates, in a state pressuring the supporting member 93 while clamping the sheet S in between, the pressuring member 91 follows the supporting member 93 moving at the operation speed corresponding to the selected operation mode and moves (see FIG. 5A).

From when the sheet S is clamped between the pressuring member 91 and the supporting member 93 in the sheet clamping position to when the rear edge of the sheet S is ejected from the sheet ejecting roller 80*a* (to when the rear edge of the sheet S separates from the nipping section of the sheet ejecting roller 80*a*), the sheet S is conveyed by the conveying force of the sheet ejecting roller 80*a*.

Then, when the rear edge of the sheet S separates from the nipping section of the sheet ejecting roller 80*a*, the conveying power by the sheet ejecting roller 80*a* fades and the sheet S moves according to the movement of the supporting member 93 in a state clamped between the pressuring member 91 and the supporting member 93. In other words, the movement speed of the sheet S is the same speed as the operation speed of the pair of sheet clamping members.

Figure 5B:
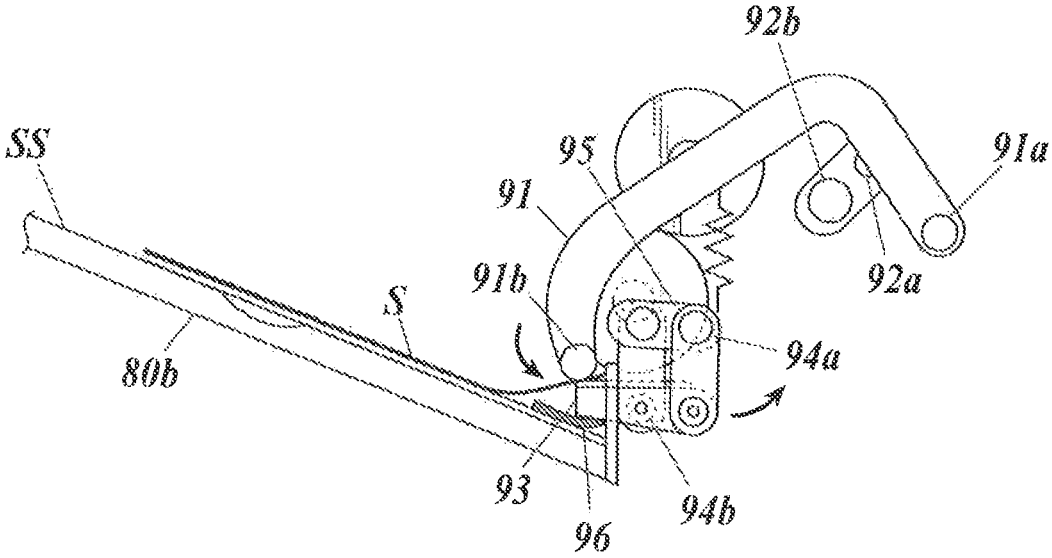
FIG. 5B is a cross-sectional diagram along line A-A shown in FIG. 2 for describing the operation of the pressuring member and the supporting member.
Figure 6A:
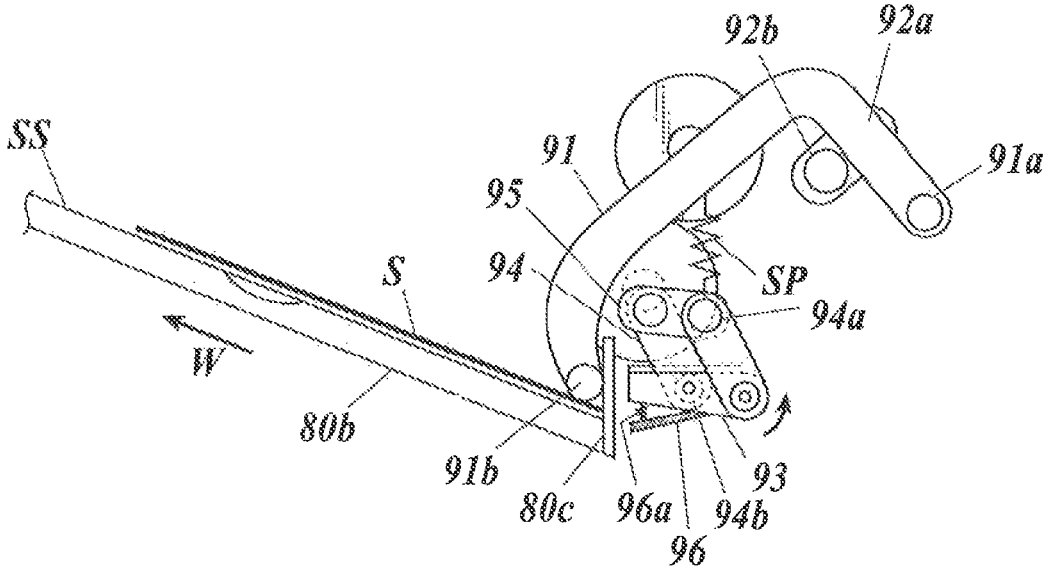
FIG. 6A is a cross-sectional diagram along line A-A shown in FIG. 2 for describing the operation of the pressuring member and the supporting member.
Figure 6B:
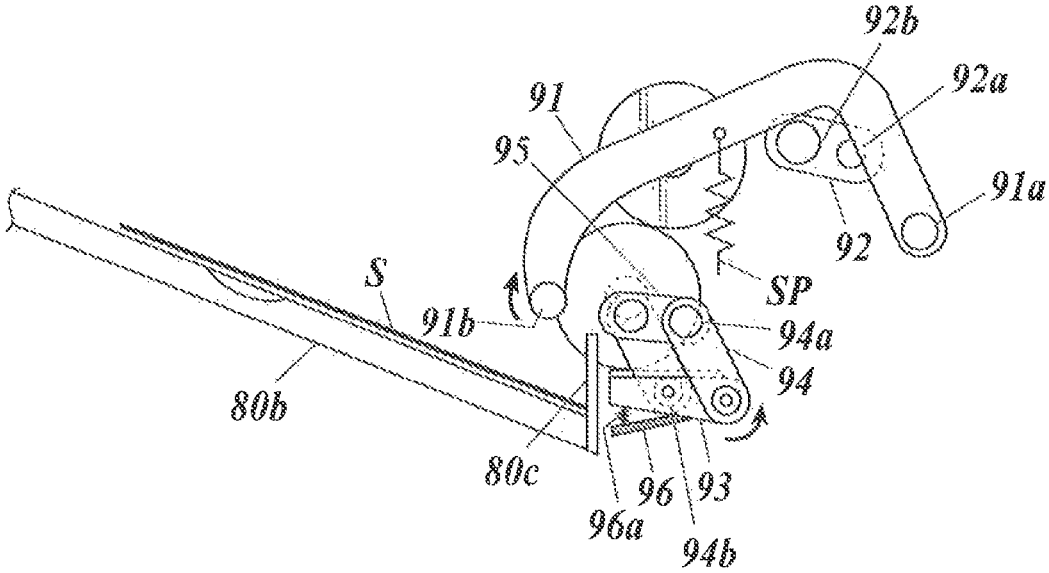
FIG. 6B is a cross-sectional diagram along line A-A shown in FIG. 2 for describing the operation of the pressuring member and the supporting member.

When the sheet S reaches the sheet stacking position, the sheet clamping face 93*a* of the supporting member 93 separates from the sheet S and the supporting member 93 separates from the pressuring member 91 to move to the upstream side which is in the direction opposite of the sheet ejecting direction (see FIG. 5B).

Then, the pressuring member 91 is biased by the spring member SP and presses the sheet S to the rising and falling sheet ejection dish 80*b* (see FIG. 6A). in this state, the stacking of the sheet S to the rising and falling sheet ejection dish 80*b* ends.

Then, the pressuring member 91 rotates clockwise with the clockwise rotation of the pressuring regulating member 92 and returns to the original evacuation position latched to the pressuring regulating member 92. The supporting member 93 rotates in the counter clockwise direction and returns to the sheet clamping position (see FIG. 6B), Here, since the friction coefficient of the sheet clamping face 93*a* of the supporting member 93 is larger than the friction coefficient of the pressuring section 91*b* of the pressuring member 91 and the friction coefficient between the sheets, it is possible to bump the rear edge of the sheet S to the bumping section 80*c*.

When the rear edge of the sheet S stacked on the top of the rising and falling sheet ejection dish 80*b* is misaligned to the downstream side of the ejecting direction than the rear edge of the sheet S, the misalignment can be corrected by the effect when the friction member 96 comes into contact with the sheet S stacked on the top.

In other words, as shown in FIG. 5B, the friction member 96 provided to the supporting member 93 comes into contact with the upper face of the sheet S stacked on top, the sheet S is biased to the upstream side of the sheet ejecting direction and the rear edge of the sheet S bumps the bumping section 80*c*.

Here, since the spring member 96*a* extends and shortens according to the thickness of the batch. of sheets stacked on the rising and falling sheet ejection dish 80*b*, the friction member 96 constantly comes into contact with the top sheet of the rising and falling sheet ejection plate 80*b* at a suitable height.

Then, similarly, the sheet S is ejected from the sheet ejecting roller 80*a* and the batch of sheets with the rear edge aligned is stacked on the rising and falling sheet ejection dish 80*b*.

As described above, according to the present embodiment, the operation speed of the pair of sheet clamping members (pressuring member 91 and supporting member 93) is selected between the normal mode in which the operation speed of the pair of sheet clamping members is a normal speed and the low speed mode in which the speed is lower than the normal speed. Therefore, it is possible to apply the low speed mode when clamping a sheet which easily slips or clamping a plurality of sheets of overlapped sheets. If the operation speed of the pair of sheet clamping members is low, it is possible to prevent the sheet S from slipping. Therefore, it is possible to enhance the alignment of stacking the sheet S which easily slips without increasing the gripping force of the pair of sheet clamping members.

Moreover, it is possible to apply the normal mode for the sheet which does not easily slip. Therefore, it is possible to avoid the speed of stacking becoming needlessly slow.

Specifically, in the present embodiment, the control section 100 selects the normal mode or the low speed mode based on the sheet type information of the ejected sheet S. Therefore, it is possible to automatically switch the operation mode based on the sheet type information.

The present invention is not limited to the above embodiment and suitable modifications can be made.

For example, the above embodiment describes switching the operation mode based on the sheet type information. However, the operation mode can be switched according to other conditions.

As other conditions, there is, for example, the number of overlapped sheets S ejected. Specifically, when the ejected sheet S is one sheet, the control section selects the normal mode, and when the ejected sheet S is a plurality of sheets, the control section selects the low speed mode.

As other conditions, there is the sheet conveying speed from the image forming device B side or the interval of conveying the sheet S from the image forming device B side.

An example of employing the sheet conveying speed as the condition is specifically described. When the sheet conveying speed of the sheet S conveyed from the image forming device B is higher than a predetermined speed, the control section 100 selects the normal mode, and when the speed is the predetermined speed or lower, the control section 100 selects the low speed mode.

An example of employing the interval of the conveying sheet S as the condition is specifically described. When the interval of the sheet S conveyed successively from the image forming device B is smaller than a predetermined interval, the control section 100 selects the normal mode, and when the interval is a predetermined interval or more, the control section 100 selects the low speed mode.

It is possible to further divide the low speed mode to a plurality of speeds and to combine the above conditions to create further detailed conditions, and then to associate the divided plurality of low speed modes to the conditions to be optimized. The association between the condition and each low speed mode is obtained by various experiments and simulations.

The operation mode freely selected by the user can be input to the operation section such as the operation/display section B2 and the control section 100 can select the normal mode or the low speed mode based on the input operation mode. With this, it is possible to enhance usability.

The present embodiment includes the operation/display section B2 so that the user can perform setting operation to drive both or one of the pressuring member 91 or the supporting member 93 when each sheet is ejected by the sheet ejecting roller 80*a*. According to the setting operation by the operation/display section B2, at least one of the pressuring member 91 or the supporting member 93 is driven.

Therefore, the user can optionally set the operation of the pressuring member 91 and the supporting member 93 according to the setting environment, etc. of the apparatus and the usability is enhanced.

According to an aspect of the preferred embodiments of the present invention, there is provided a sheet ejecting device including:

a sheet stacking section to stack a sheet ejected one sheet at a time or sheets ejected in a state where a plurality of sheets are overlapped by an ejecting section of an image forming device;

a bumping section which is bumped by a rear edge in a sheet ejecting direction of the sheet stacked on the sheet stacking section;

a sheet ejecting section including a pair of sheet clamping members which clamps the one sheet or the plurality of overlapped sheets at a sheet clamping position and moves the one sheet or the plurality of overlapped sheets to a sheet stacking position in the sheet stacking section;

a mode selecting section to select an operation mode of the pair of sheet clamping members between a normal mode in which an operation speed of the pair of sheet clamping members is a normal speed and a low speed mode in which a speed is lower than the normal speed; and a control section which operates the pair of sheet clamping members based on a selected result of the mode selecting section.

Consequently, the operation speed of the pair of sheet clamping members is selected between the normal mode in which the operation speed of the pair of sheet clamping members is a normal speed and the low speed mode in which the speed is lower than the normal speed. Therefore, it is possible to apply the low speed mode when clamping a sheet which easily slips or clamping a plurality of sheets of overlapped sheets. If the operation speed of the pair of sheet clamping members is low, it is possible to prevent the sheet from slipping. Therefore, it is possible to enhance the alignment of stacking the sheet which easily slips without increasing the gripping force of the pair of sheet clamping members.

Moreover, it is possible to apply the normal mode for the sheet which does not easily slip. Therefore, it is possible to avoid the speed of stacking becoming needlessly slow.

Preferably, the mode selecting section selects the normal mode or the low speed mode based on sheet type information of the ejected sheet.

Consequently, according to the present embodiment, the normal mode or the low speed mode is selected based on the sheet type information of the ejected sheet. Therefore, it is possible to automatically switch the operation mode based on the sheet type information.

Preferably, the mode selecting section selects the normal mode or the low speed mode based on a number of the overlapped sheets ejected.

Consequently, the normal mode or the low speed mode is selected based on the number of overlapped sheets ejected. Therefore, when the ejected sheet is one sheet, the normal mode is selected, and when the ejected sheet is a plurality of sheets, the low speed mode is selected.

Preferably, the mode selecting section selects the normal mode or the low speed mode based on a sheet conveying speed from the image forming device or an interval of a conveyed sheet from the image forming device.

Consequently, in a case where the normal mode or the low speed mode is selected based on the sheet conveying speed from the image forming device, when the sheet conveying speed of the sheet conveyed from the image forming device is higher than a predetermined speed, the normal mode is selected, and when the speed is the predetermined speed or lower, the low speed mode is selected.

Alternatively, in a case where the normal mode or the low speed mode is selected based on the interval of the conveyed sheet, when the interval of the sheet conveyed successively from the image forming device is smaller than a predetermined interval, the normal mode is selected, and when the interval is a predetermined interval or more, the low speed mode is selected.

Preferably, the sheet ejecting device further includes an operation section to input an optionally selected operation mode to the mode selecting section, wherein the mode selecting section selects the normal mode or the low speed mode based on an operation mode selected by the operation section.

Consequently, the operation mode freely selected by the user can be input to the operation section and the normal mode or the low speed mode is selected based on the input operation mode. With this, it is possible to enhance usability.

The present application is based on Japanese Patent Application No. 2012-012558 filed on Jan. 25, 2012 to the Japanese Patent Office, which shall be a basis for correcting mistranslations.

What is claimed is:

1. A sheet ejecting device comprising:

a sheet stacking section which stacks a single ejected sheet or a plurality of ejected sheets which form a plurality of overlapped sheets;

a bumping section which is bumped by a rear edge in a sheet ejecting direction of the sheet stacked on the sheet stacking section;

a sheet ejecting section including a pair of sheet clamping members which clamp the single sheet or the plurality of overlapped sheets at a sheet clamping position and move the single sheet or the plurality of overlapped sheets to a sheet stacking position in the sheet stacking section;

a moving section which moves the sheet clamping members from the sheet clamping position to the sheet stacking position;

a mode selecting section which selects an operation mode of the moving section between a normal mode and a low speed mode, wherein an operation speed of the moving section is a normal speed in the normal mode and the operation speed al the moving section is lower than the normal speed in the low speed mode; and a control section configured to operate the moving section based on a selected result of the mode selecting section, wherein the mode selecting section selects the normal mode or the to speed mode based on whether the single sheet is ejected or the plurality of sheets are ejected.

2. The sheet ejecting device of claim 1, wherein the mode selecting section selects the normal mode or the low speed mode based on sheet type information or the ejected sheet in combination with whether the single sheet is ejected or the plurality of sheets are ejected.

3. The sheet ejecting device of claim 1, wherein the mode selecting section selects the normal mode or the low speed mode based on a sheet conveying speed from the image forming device or an interval of a conveyed sheet from the image forming device in combination with whether the single sheet is ejected or the plurality of sheets are ejected.

4. The sheet ejecting device of claim 1, wherein the moving section moves the sheet clamping members from the sheet clamping position to the sheet stacking position while the clamping members clamp the sheet therebetween.

5. The sheet ejecting device of claim 1, wherein the sheet stacking position is located downstream from the sheet clamping position in the sheet ejecting direction.

6. A sheet ejecting device comprising:

a sheet stacking section which stacks a single ejected sheet or a plurality of ejected sheets which form a plurality or overlapped sheets;

a bumping section which is bumped by a rear edge in a sheet ejecting direction of the sheet stacked on the sheet stacking section;

a sheet ejecting section including a pair of sheet clamping member which clamp the single sheet or the plurality of overlapped sheets at a sheet clamping position and move the single sheet or the plurality of overlapped sheets to a sheet stacking position in the sheet stacking section;

a moving section which moves the sheet clamping members from the sheet clamping position to the sheet stacking position;

a mode selecting section which selects an operation mode of the moving section between a normal mode and a low speed mode, wherein an operation speed of the moving section is a normal speed in the normal mode and the operation speed of the moving section is lower than the normal speed in the low speed mode;

a control section configuration to operate the moving section based on a selected result of the mode selecting section, and an operation section to input an optionally selected operation mode to the mode selecting section, wherein the mode selecting section selects the normal mode or the low speed mode based on an operation mode selected by the operation section.

7. The sheet ejecting device of claim 6, wherein the moving section moves the sheet clamping members from the sheet clamping position to the sheet stacking position while the clamping members clamp the sheet therebetween.

8. The sheet ejecting device of claim 6, wherein the sheet stacking position is located downstream from the sheet clamping position in the sheet ejecting direction.

9. The sheet ejecting device of claim 6, wherein the mode selecting section selects the normal mode or the low speed mode based on sheet type information of the ejected sheet.

10. The sheet ejecting device of claim 6, wherein the mode selecting section selects the normal mode or the low speed mode based on a sheet conveying speed from the image forming device or an internal of a conveyed sheet from the image forming device.

11. A sheet ejecting device comprising:

a sheet stacking section which stacks a single ejected sheet or a plurality of ejected sheets being overlapped;

a bumping section which is bumped by a rear edge in a sheet ejecting direction of the sheet stacked on the sheet stacking section;

a sheet ejecting section including a pair of sheet clamping members which clamp the single sheet or the plurality of overlapped sheets at a sheet clamping position and moves the single sheet or the plurality of overlapped sheets to a sheet stacking position in the sheet stacking section;

a mode selecting section which selects an operation mode of the pair of sheet clamping members between a normal mode and a low speed mode based upon whether the single sheet is ejected or the plurality of overlapped sheets are ejected, wherein an operation speed of the pair of sheet clamping members is a normal speed in the normal mode and the operation speed of the pair of sheet clamping members is lower than the normal speed in the low speed mode; and a control section configured to operate the pair of sheet clamping members based on a selected result of the mode selecting section.

12. A sheet ejecting device comprising:

a sheet stacking section which stacks a single sheet or a plurality of overlapped sheets ejected from an image forming apparatus;

a bumping section which is bumped by a rear edge in a sheet ejecting direction of the sheet stacked on the sheet stacking section;

a sheet ejecting section including a pair of sheet clamping members which clamp the single sheet or the plurality of overlapped sheets at a sheet clamping position and moves the single sheet or the plurality of overlapped sheets to a sheet stacking position in the sheet stacking section;

an operation section to input an optionally selected operation mode to the mode selecting section;

a mode selecting section which selects an operation mode of the pair of sheet clamping members between a normal mode and a low speed mode based, an operation mode selected by the operation section, wherein an operation speed of the pair of sheet clamping members is a normal speed in the normal mode and the operation speed of the pair of sheet clamping members is lower than the normal speed in the low speed mode; and a control section configured to operate the pair of sheet clamping members based on a selected result of the mode selecting section.

* * * * *